US005400936A

United States Patent [19]

Jones et al.

[11] Patent Number: 5,400,936

[45] Date of Patent: Mar. 28, 1995

[54] ARM BAND MAP HOLDER

[76] Inventors: Richard M. Jones; Lynda W. Jones, both of 511-A River Rd., Austin, Tex. 78734

[21] Appl. No.: 194,927

[22] Filed: Feb. 14, 1994

[51] Int. Cl.[6] ..... A45F 3/50

[52] U.S. Cl. ..... 224/222; 224/219; 40/904

[58] Field of Search ..... 224/219, 221, 222, 267, 224/901, 277, 30 A; 40/904

[56] References Cited

U.S. PATENT DOCUMENTS

| | | | |
|---|---|---|---|
| D. 259,220 | 5/1981 | Small et al. | 224/219 |
| D. 300,786 | 4/1989 | Josselyn | 224/901 |
| 1,430,207 | 9/1922 | Woodhouse | 224/277 |
| 1,844,311 | 2/1932 | Cobbs | 224/277 |
| 3,543,977 | 12/1970 | Lockridge | 224/222 |
| 4,415,106 | 11/1983 | Connell et al. | 40/904 |
| 4,763,821 | 8/1988 | Powell | 224/222 |
| 5,170,917 | 12/1992 | Tourigny | 224/219 |
| 5,178,311 | 1/1993 | McBride | 40/904 |

*Primary Examiner*—Henry J. Recla
*Assistant Examiner*—Charles R. Eloshway

[57] ABSTRACT

A lightweight arm band map holder which easily fits onto a skier's limb provides a safe, convenient view of an appropriate map. The map holder further includes a pliable transparent window for carrying a ski area trail map (or other printed information) and a flexible pocket for carrying small articles within the arm band map holder.

5 Claims, 2 Drawing Sheets

ARM BAND MAP HOLDER

BACKGROUND OF THE INVENTION

1. Field of the Invention

The present invention relates to a map holder apparatus (or holder of other information, particularly readable information), and pertains to a new and improved arm band map holder, arranged for easy access by an individual or companion. More particularly the present invention relates to a map holder arranged to display a ski area trail map, which remains easily accessible to both skier and companion when necessary (for example, while sitting on the chair lift, stopped on a trail, or before entering a particular area of difficulty for the skier). While the present invention will be described with reference to downhill skiers, the invention is not to be limited by such references, thus the present invention claims alternative uses in other recreational fields.

2. Description of the Prior Art

With the increasing growth of recreational activities, downhill skiing and cross country skiing have become two of the most popular sports enjoyed around the world. Skiing facilities have increased their geographic areas and their maximum capacity for handling skiers, particularly such ski areas found in the western mountain regions. While many of these ski areas comprise a vast amount of acreage, incorporating varying degrees of difficult ski trails, it is recommended and considered a safety precaution for all skiers to carry a trail map of the area, to insure the skier of travelling the appropriately marked trails compatible with their skiing ability.

Such ski area trail maps are provided free of charge to the skier and are comprised of thin paper, which can be easily torn while a skier removes it from a securely zipped pocket. Skiers frequently fight frustration when accessing their trail map stored away in a pocket, such maps are easily torn, lost and often cause skiers to lose a pole, glove or other article. The present invention addresses the time consuming and cumbersome maneuver of accessing a hidden trail map, while wearing heavily insulated gloves or mittens, carrying a pair of ski poles, or needing to unzip a jacket to reveal a hidden map. Also, the present invention addresses the problem of accessing and viewing a ski area trail map while riding the ski chair lift, allowing the skier to reference the trail map without the removal of a glove, providing free movement of both hands. The convenient accessibility of this invention allows the skier to remain safer in the chair and avoid the possibility of losing an article such as a glove, mitten or ski pole.

Earlier map holders are too cumbersome, unattractive and meet only a few of the skier's needs. U.S. Pat. No. 5,178,311 to McBride (1993) discloses a skier's map holder hung around the neck. Before viewing, this map holder must be removed from the inside of a jacket or sweater, causing the skier to use at least one hand, possibly both, in order to access the trail map. Also, to access a zippered pocket or jacket front the skier usually must remove at least one mitten or glove. If such a map holder is worn on the exterior for easier map referencing, this map holder will constantly be slapping the skier in the face, posing a potential hazard to the skier. Therefore, McBride's patent 5,178,311 does not offer complete freedom of hands and arms for the skier or recreational enthusiast.

U.S. Pat. No. 4,415,106 to Connell and Swanson addresses the problem of inaccessible ski trail maps. The wrist mounted map holder U.S. Pat. No. 4,415,106 is positioned on an arm or leg of the skier by strap sections, such as a buckle and/or snaps; such hardware easily breaks, unfastens during strenuous activities and could need repairs. Such breakage results in losing the map holder apparatus and enclosed trail map, thus adding to the skier's frustration when needing to access a trail map. While skiing, many individuals are concerned with attaining a particular style, driven by current fashion trends. U.S. Pat. No. 4,415,106, the wrist mounted plastic map holder apparatus manufactured from unattractive transparent material and strap sections can destroy the desired image and fashion trend sought by the skier.

Another map holder that proves too cumbersome to be worn during skiing or other strenuous activities is U.S. Pat. No. 5,183,193 to Brandell (1993). This wrist mounted map holder contains an apparatus designed to support a magnifying lens or light. The general construction of U.S. Pat. No. 5,183,193 comprising a support apparatus strong enough to hold a magnifying lens or light proves to cumbersome and heavy, an obvious hindrance for any recreational activity. Furthermore, the rigid support apparatus remains intact and completely inflexible, posing a definite safety hazard for any skier. Therefore, U.S. Pat. No. 5,183,193 will not serve as a recreational enthusiasts' map holder, since such enthusiasts have a constant need for complete range of motion.

The present invention was developed particularly to address and solve the above described problems whereby an individual, for example a skier, expert or novice, is provided with instant map availability for convenient referencing without requiring the removal of ski pole straps, ski gloves or mittens, the unzipping of a secure pocket with cold hands, then the reversal of this procedure in order to continue the recreational activity.

SUMMARY OF THE INVENTION

Accordingly, the first object of the present invention provides a new and improved arm mounted information holder (that is, a holder of printed information, such as a map holder) that is easily accessible to the person carrying the information, or a companion, whenever either person needs to refer to the information.

A second object of the present invention provides a lightweight, flexible, sleeve, including a pliable transparent window securely closed by a "Velcro" hook and loop attachment (or other type of closing device, e.g. zipper, snaps). The said window receives a map therewithin for ease of visual observation by an individual engaged in recreational activities, for example, downhill skiing and cross country skiing.

A further object of the present invention provides a map holder apparatus which allows for convenient and instant map referencing without the use of hands, thus enhancing freedom of motion for the individual during the maneuvers of recreational activities, e.g. downhill and cross country skiing, equestrian eventing, piloting, motorcycling.

Another object of the present invention provides a map holder designed for comfortable map viewing without any physical hindrances, more particularly those hindrances encountered by a skier, for example, the time consuming and cumbersome maneuver of removing heavy gloves or mittens, retrieving the map from an obscure pocket or other restrictive positions.

Furthermore, an additional object of the present invention is to provide a trail map holder which can be manufactured from brightly colored flexible, lightweight materials, possibly colored in several colors simultaneously, and decorated to suit individual's taste, and satisfy fashion trends.

It is still another object of the present invention to provide a trail map holder which will be weather repellent, protecting the withheld information from nature's elements, e.g. snow, rain, sleet, and wind.

Another object of the present invention is to provide an arm mounted map holder which will remain durable, not disposable, and easily maintained. Furthermore the present invention can be manufactured easily and inexpensively in various sizes to accommodate any size forearm.

Objectively, the present invention provides an arm mounted map holder which stays in place on a jacket sleeve during skiing and even upon removing the jacket or sweater. The present map holder apparatus is developed with a plurality of elastic or other such means of tightening the map holder to grip the jacket sleeve (e.g. "Velcro" hook and loop fasteners, drawstrings, snaps, zipper). Such means for securing the map holder is sewn onto each side of the arm band, allowing the map holder to remain in place.

The present invention provides a map holder which contains an extra security pocket for carrying small articles, e.g. identification, emergency information, sunscreen, money, medication, lipstick, and eye-drops. Such security pocket is developed to strengthen the attachment of the transparent window and to enhance the usage of the arm mounted map holder.

Additional objects of the present invention include the advantages of a map holder which promotes safe skiing-providing means for carrying a readily available map, identification and emergency information; to provide a trail map holder which serves a diversity of enthusiasts--downhill and cross-country skiers, snowmobilers, motorcyclists, equestrians, pilots, hikers, and even baggage handlers at airports; to provide an enthusiast with a novel and attractive aide to map referencing; to produce a reusable, reliable and ecologically safe product with high marketing potential; to produce an accessory that will serve and satisfy existing needs of a large population and can be used for numerous activities; to provide an easily operated trail map holder that can change superficial appearances according to current trends, without changing its basic structure; to provide a trail map holder that will not become obsolete.

Accordingly, the reader will see that our invention of the skier's arm band for carrying a trail map provides instant, hands free map viewing, and can eliminate the frustration suffered from torn maps, lost articles or skiing the inappropriate trail. With this arm band conveniently attached to your coat sleeve, there are no cumbersome apparatuses or dangling strings with plastic to hinder your physical performance.

Although the description above contains many specifications, these should not be construed as limiting the scope of the invention but as merely providing illustrations of some of the presently preferred embodiments of this invention. For example, the sizes of the arm band can be altered to fit any size arm or leg, and the sizes of the window and pocket can change to accommodate various sports. Also, the arm band can be constructed without including the interior pocket. Other alternative ways to construct the arm band would be the addition of various gadgets attached by various means, for example including a watch, wallet, and compass. Thus, the scope of the invention should be determined by the appended claims and their legal equivalents, rather than by the examples given.

Figure 1:
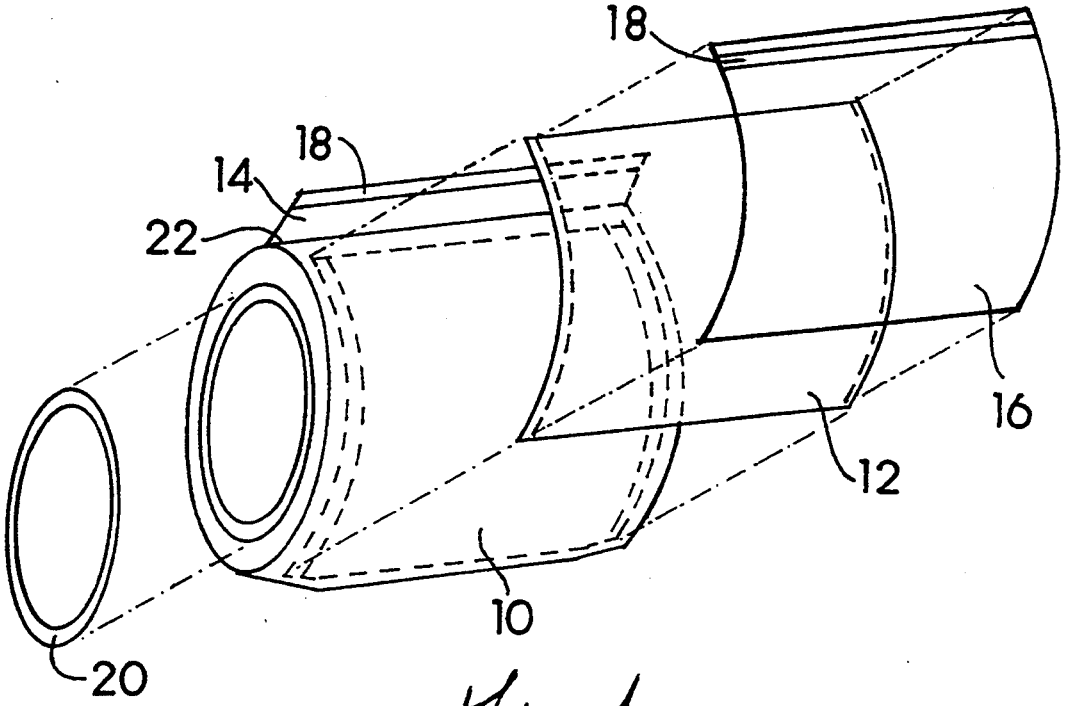
FIG. 1 is an exploded view of the present invention, revealing all its components.

| REFERENCE NUMERALS IN DRAWINGS | |
|---|---|
| 10 Body of present invention | 1 Skier |
| 12 Pocket | 3 Transparent Window |
| 14 Flap | 5 Present Invention |
| 16 Transparent Window | 7 Ski pole |
| 18 Closing device | 9 Ski chair lift |
| 20 Gripping device | |
| 22 Seam | |

DESCRIPTION OF THE PREFERRED EMBODIMENT

While the present invention will be described in connection with specific and preferred embodiments, it will be understood that it is not intended to limit the invention to those embodiments. To the contrary, it is intended to cover all alterations, modifications and equivalents as may be included within the spirit and scope of the invention as defined by the appended claims.

With reference to the drawings, and particularly to FIGS. 1 to 4 thereof, a new and improved arm band map holder apparatus embodying the principles and concepts of the present invention will be described.

FIG. 1 illustrates the present invention in an exploded view, revealing each component and its direct placement in relation to the map holder apparatus as a whole element. In FIG. 1, numeral 10 represents the main body of the arm mounted map holder, which is a rectangular shaped flexible, lightweight material. A preferred embodiment of such material is a weather resistant, attractive fabric. Numeral 12 shows the pocket of the present invention, made from the same or similar flexible, lightweight material as body 10, and its direct placement upon body 10.

A preferred embodiment of transparent window 16 is of pliable, transparent vinyl. Numeral 18 depicts the closing device necessary to seal the opening for respective pocket 12 and window 16. The preferred embodiment of closing device 18 is "Velcro" hook-and-loop fastener or any other closing device, for example a zipper, snaps and ziplock seal. Such closing devices are comprised of two elements, with one fastening tightly into the other, for example by means of gripping, hooking or sealing.

Initially, one element of closing device 18 is attached by means of sewing onto window 16. Transparent window 16 is attached by means of sewing to pocket 12, and for added strength, window 16 and pocket 12 are attached simultaneously to body 10.

Body 10 is constructed of the appropriate size fabric to accommodate the skier's arm or limb. Body 10 is rectangular shaped and included in its length is flap 14. The size of flap 14 can be altered according to type of closing device 18 chosen for securing flap 14 to transparent window 16. The second element of closing device 18 is attached by means of sewing to flap 14.

A preferred embodiment of gripping device 20 is elastic; alternative means for gripping device 20 could include drawstring, "Velcro" hook and loop fasteners, and any combination of these devices. Gripping device 20 should be properly adjusted to fit skier's arm so as to be worn comfortably and safely. Gripping device 20 exists in plurality with both devices extending opposite sides lengthwise along rectangular shaped body 10. Gripping device 20 is attached along the length of rectangular body 10, with one end of gripping device 20 sewn near the end of body 10 without including flap 14. Gripping device 20 extends the entire length of the rectangular shape to the opposite end where pocket 12 and window 16 are attached.

A final procedure in the construction of the present invention includes attaching the two shorter ends of rectangular body 10 together, forming seam 22 along the inner edge of flap 14, connecting it to the opposite end of body 10, near pocket 12 and window 16. Seam 22 attaches flap 14 to opposite end of body 10 without sewing over pocket 12 and window 16.

Figure 2:
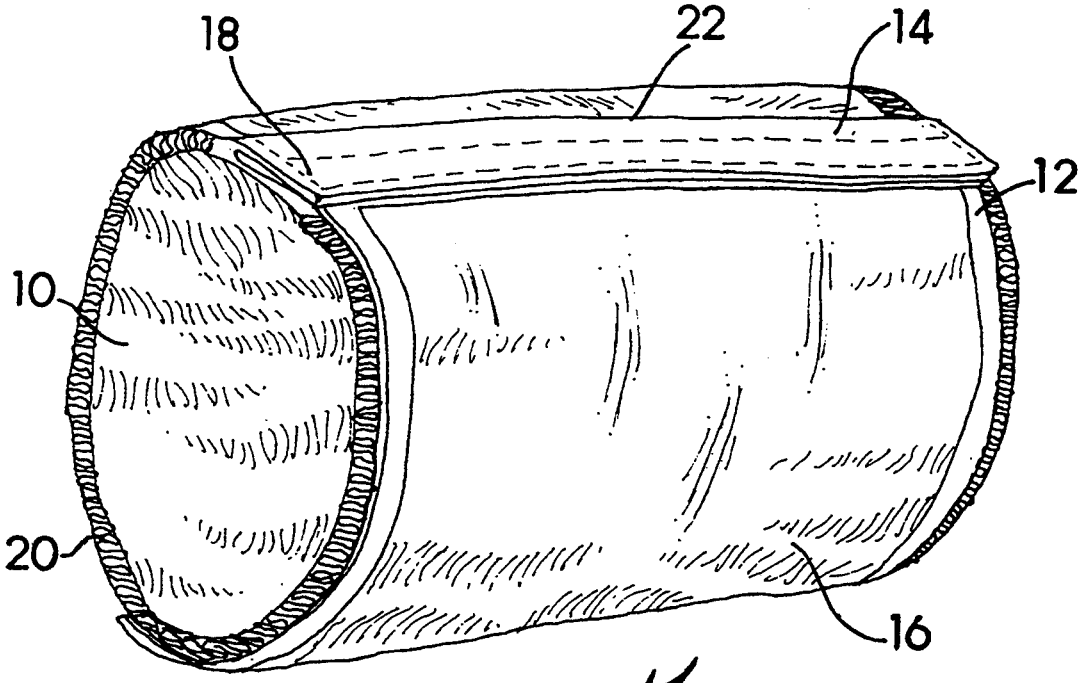
FIG. 2 is a front perspective view of the present invention.

The general shape of the present invention will be cylindrical, with plural edges gathered by gripping device 20. FIG. 2 represents a preferred embodiment of the present invention, giving the present invention the general appearance of a sleeve.

FIG. 2 shows the present invention from a frontal perspective, revealing its components as they appear in the finished product. Body 10 becomes a cylindrical shaped arm band map holder, comprised of pocket 12 for securing small articles needed while skiing, e.g. emergency identification, money, sunscreen. Also comprising body 10 is window 16, a transparent pliable vinyl material in which a map is placed for viewing. The security and weatherproof seal of closing device 18, mounted onto flap 14 and window 16, ensures against snow entering the opening used to access map in window 16 and essentials in pocket 12.

In FIG. 2 the cylindrical shape of body 10 is achieved by attaching gripping device 20, in its plurality, to both lengthwise edges of body 10. Seam 22, attaching the shorter opposite ends of body 10 gives the present invention its identifiable shape.

Figure 3:
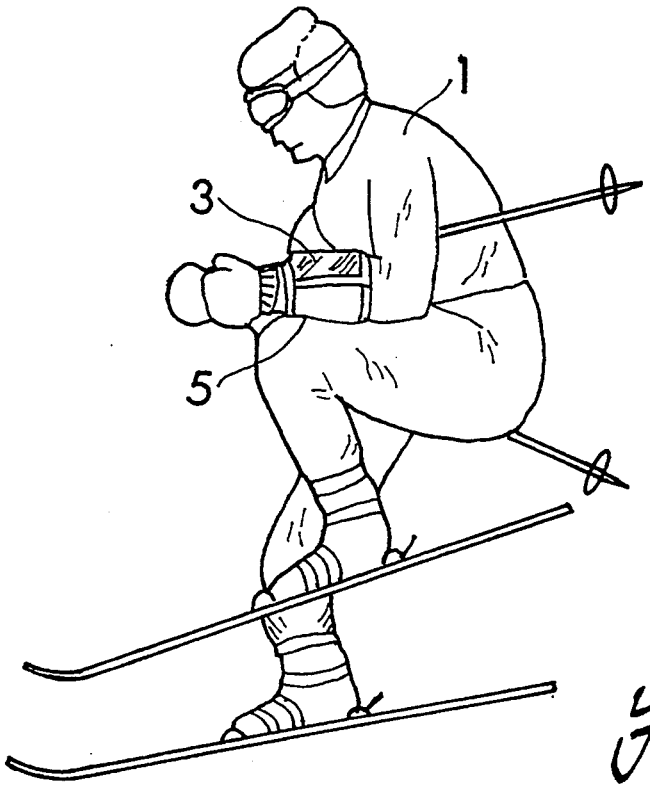
FIG. 3 shows the present invention in use on a skier's forearm, while skiing.

FIG. 3 shows skier 1 wearing present invention 5 while skiing. At no time does present invention 5 interfere with the physical performance of skier 1. While wearing present invention 5, transparent window 3 is readily accessible for instant map referencing. Furthermore, present invention 5 remains in a secure position on the arm of skier 1, without slippage, allowing transparent window 3 to be in constant view. Because of the secure nature of present invention 5, skier 1 can perform with full range of motion of all limbs.

Figure 4:
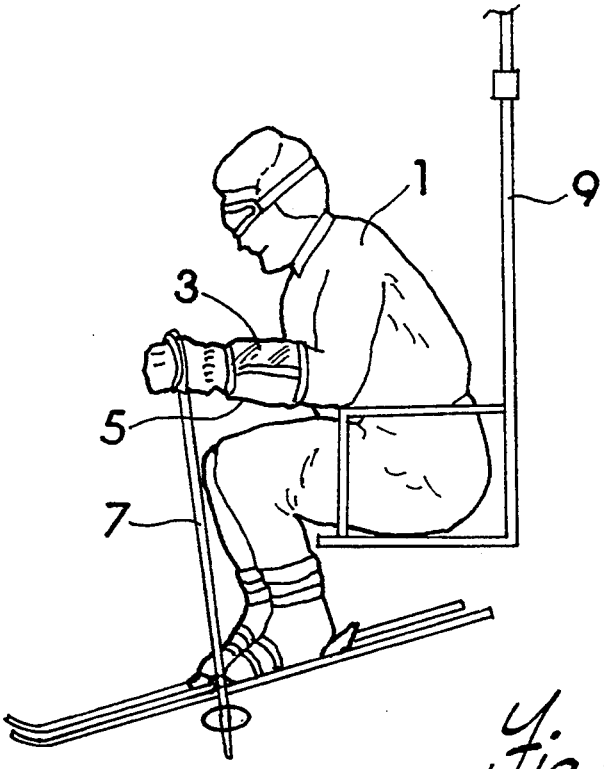
FIG. 4 depicts the present invention in use on a skier's forearm while sitting on a chair lift.

The illustration in FIG. 4 depicts skier 1 sitting on chair lift 9 using present invention 5 without the use of hands. While viewing transparent window 3 it is not necessary to remove ski pole 7 from hands or remove a glove to access a trail map. With this ease, skier 1 can reference the trail map without posing a risk of losing articles, e.g. ski pole 7, gloves, mittens.

Referring respectively to FIGS. 3 and 4, because of the general construction of present invention 5, skier 1 retains full physical ability to participate in the recreational sport, while carrying an arm mounted map holder to ensure safety and ski area orientation. Skier 1 remains safer in chair lift 9 while wearing present invention 5, referencing transparent window 3 without shifting body position and risking danger from imbalance.

While the present invention has been described in connection with various embodiments, the invention is not limited to such embodiments. Many alternatives to the above described embodiments can be implemented in construction of the present invention. For example, in FIG. 2 the size of transparent window 16 and pocket 12 can be altered to accommodate any size information desired to be displayed or carried in present invention. As stated earlier, many different styles and types of lightweight, flexible fabrics can be used for body 10 and pocket 12, both of which can be altered to accommodate the size of arm and activity in which the present invention will be used. Various types of gripping device 20 can be utilized to ensure proper fitting. Also, alternative types of closing device 18 can include zippers, hook fasteners, and snaps.

Operation of the present invention requires the user to unfasten flap 14, releasing closing device 18, to reveal an opening of transparent window 16 into which user places proper information. Other necessary articles, for example identification, money, sunscreen, can be placed into pocket 12. Afterwards, flap 14 is then securely fastened to transparent window 16 by means of closing device 18. User places arm into open end of body 10, as if putting on a sleeve, adjusting body 10 so that it fits comfortably onto the arm, leaving transparent window 16 upwardly visible to the user. Proper operation of the present invention allows user instant map referencing and free use of hands and arms while engaging in a recreational activity.

Having shown and described several embodiments in accordance with the present invention, it is understood that the same is not limited thereto but is susceptible of numerous changes and modifications as known to one having ordinary skill in the art. We therefore do not wish to be limited to the details shown and described herein, but intend to cover all such modifications as are encompassed by the scope of the appended claims and equivalents thereof.

We claim:

1. An arm band for holding legible information on a person's arm in a readable position allowing free range of motion of the arm and associated hand, comprising:

a body comprised of a lightweight cylindrical piece of flexible fabric, said body having two open circular ends for accommodating said arm therethrough;

a first flap comprised of said lightweight flexible fabric and attached to an exterior section of said body, said flap and said body forming a first pocket therebetween for holding personal articles;

a window comprised of a transparent flexible material and attached to an exterior section of said first flap, said window and said first flap forming a second pocket therebetween for holding said legible information;

a gripping device circumferentially attached to each said open circular end of said body, each said gripping device adapted to secure said arm band to said arm;

a second flap extending from said body and being of sufficient size to form a closure for said first and second pockets;

a first closing device attached to said second flap; and, a second closing device attached to an exterior portion of said window, said second closing device adapted to mate with said first closing device so as to provide a weatherproof closure for said first and second pockets.

2. An arm band according to claim 1 wherein said window is comprised of weatherproof transparent vinyl.

3. An arm band according to claim 1 wherein said first and second closing devices are hook and loop type fasteners.

4. An arm band according to claim 1 wherein said first and second closing devices comprise a zipper mechanism.

5. An arm band according to claim 1 wherein each said gripping device is a drawstring.

* * * * *